United States Patent [19]

Martinsen

[11] Patent Number: 4,597,515

[45] Date of Patent: Jul. 1, 1986

[54] APPARATUS FOR TURNING TUBULAR GARMENT PORTIONS

[75] Inventor: Ove Martinsen, Silkeborg, Denmark

[73] Assignee: OGM Trading ApS, Silkeborg, Denmark

[21] Appl. No.: 691,549

[22] Filed: Jan. 15, 1985

[51] Int. Cl.[4] ..... A41H 43/00

[52] U.S. Cl. ..... 223/43

[58] Field of Search ..... 223/39, 40, 41, 42, 223/43, 37; 112/DIG. 2; 66/150

[56] References Cited

U.S. PATENT DOCUMENTS

| | | | |
|---|---|---|---|
| 1,737,157 | 11/1929 | Irrgang | 223/39 |
| 3,371,828 | 3/1968 | Elsas | 223/43 |
| 3,441,181 | 4/1969 | Hall | 223/43 |
| 3,516,583 | 6/1970 | Petty | 223/39 |
| 3,520,454 | 7/1970 | Saltiel | 223/43 |
| 4,047,649 | 9/1977 | Gregory | 223/43 |
| 4,223,816 | 9/1980 | Glover | 223/40 |

FOREIGN PATENT DOCUMENTS

| | | | |
|---|---|---|---|
| 217980 | 6/1924 | United Kingdom | 223/43 |

*Primary Examiner*—Louis K. Rimrodt
*Assistant Examiner*—Joseph S. Machuga
*Attorney, Agent, or Firm*—Antonelli, Terry & Wands

[57] ABSTRACT

An apparatus for turning tubular garment portions such as shirt sleeves, comprising a suction box and a pair of elbow shaped turn tubes, the shorter portions of which are connected with the suction box in a rotatable manner such that these portions are rotatable about their respective parallel axes as mutually spaced corresponding to the distance between the armholes of a shirt of a relatively small size, the longer, outer portions of the elbow shaped turn tubes thereby being mutually pivotable between substantially parallel positions and positions, in which they diverge from each other towards their free ends. Thus, the apparatus can be adjusted to handle shirts etc. of any size simply by adjusting the degree of the said divergence, to make the distance between the free intake ends of the tubes correspond to the distance between the opposed armholes of the shirt to be handled.

8 Claims, 2 Drawing Figures

APPARATUS FOR TURNING TUBULAR GARMENT PORTIONS

Figure 1:
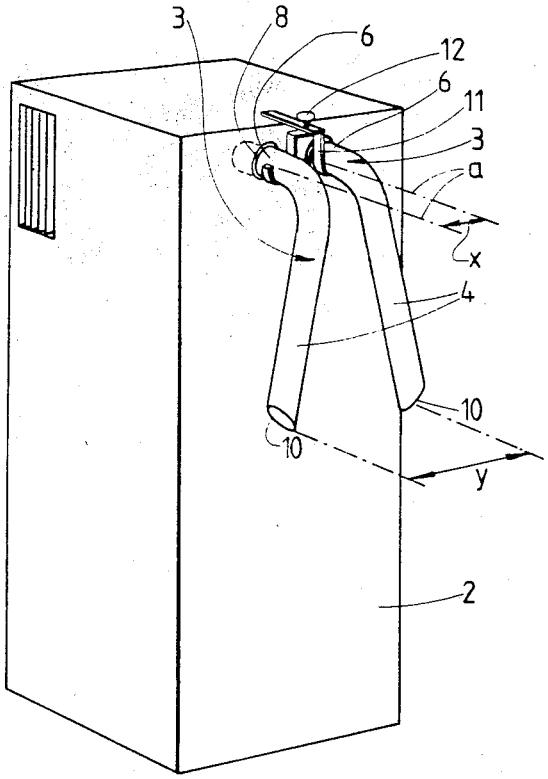

The present invention relates to an apparatus for turning tubular garment portions such as sleeves of shirts and sweaters, and of the type comprising a pair of turn tubes projecting from a suction box and operable to receive, at their outer ends, a base portion of a tubular garment portion to be turned, e.g. a sleeve armhole, whereby the tubular portion is turned into the respective turn tube by suction from said suction box, the turn tubes being mounted so as to be adjustable with respect to the distance between the outer tube ends. The turn tubes should not necessarily project any long distance from the apparatus, as it is known that they may project from a common turn chamber constituted by or connected with the said suction box, whereby the turned garment portions may both extend into the common turn chamber through the individual turn tubes.

It would of course be possible to effect turning of two connected tubular garment portions such as knitware shirt sleeves in a successive manner by means of a single turn tube, but a more rational way is to effect simultaneous turning by means of an apparatus of the above mentioned type. Such an apparatus is known from the U.S. Pat. No. 3,371,828, according to which the suction or turn chamber has a large suction opening, which is covered by a nozzle plate member as provided with two turn pipes projecting a short distance from the nozzle plate member. In order to provide for said adjustability the two turn tubes are each projecting from an eccentric portion of a circular base disc, which is rotatably secured to the nozzle plate member, whereby the distance between the outer tube ends is adjustable by mutual rotation of the circular base discs, for adaption of the distance to any new series of garments of another size. From the said Patent it is even known that the turn tubes may project from a central portion of the rotary base discs, when the single tube projects therefrom in an oblique manner corresponding to the outer tube ends being located eccentrically with respect to the base discs. The range of adjustment will be determined by the distances between the outer tube ends as these assume their oblique positions towards and away from each other, respectively.

None of these solutions, however, are ideal. The ideal shape of each outer tube end is an opening, which is turned slightly outwardly away from the opposite tube opening in order to accommodate the natural shape and direction of opposed garment armholes. Such an orientation, of course, will not be achievable in general when the tubes are adjustable by way of rotation, because the oblique openings will be rotated together with the tubes and thus be highly ideal in some positions and highly non-ideal in other positions. As a comprise it is possible to arrange for the tube end openings to be parallel with the rotary base disc, whereby the orientation of the openings will remain constant as the discs and tubes are rotated for adjustment, but another result, then, will be a constant non-adequacy of the orientation of the pipe end openings.

It is the purpose of the invention to provide an apparatus of the kind referred to, in which the turn tubes are arranged in an easily adjustable manner so as to be suitable for effective cooperation with armholes in garments of both small and large sizes.

According to the invention the turn tubes are mounted pivotally about respective, substantially parallel axes, each of which being substantially perpendicular to the direction of the outer end portions of the turn tubes, these end portions being of a considerable length e.g. as corresponding to the length of a sleeve of a garment of large size, while the distance between said pivot axes is relatively small, e.g. as corresponding to the distance between the armholes of a shirt of small size. Constructively, the turn tubes according to this arrangement may project horizontally from a suction box, parallel with and rather close to each other, each tube then projecting downwardly as the said outer end portion through a pipe bend of 90°, whereby the straight and long tube end portions may project downwardly parallel with and rather close to each other such that then free lower ends are mutually spaced corresponding to the requirements of a small size garment. The tubes being parallel and not diverging rearwardly or upwardly from their free ends, it will be easy to draw the body portion of the garment onto the tubes, and the tube end openings, already when forming right angles with the respective tube axes, will be well suited to cooperate with the armholes.

Each of the tubes as projecting from the suction box is rotatably connected with this box, i.e. from their said parallel positions the long outer tube portions outside the said pipe bends may be pivoted away from each other, whereby their outer ends may be mutually spaced to accomodate a larger size garment. The pivot angle need not be very large, i.e. the outer tube end portions or "legs38 still project generally downwardly, though now in a converging manner as seen from the outer ends thereof. Thus, the body of a garment is now still easier to draw onto the tubes, and the tube end openings will even be slightly laterally orientated, this being an ideal orientation for easy cooperation with the armholes.

Figure 2:
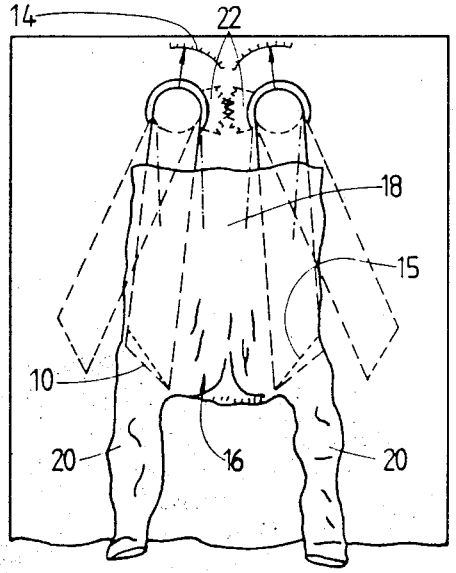

In the following the invention is described in more detail with reference to the drawing, in which:

FIG. 1 is a perspective view of an apparatus according to the invention, and FIG. 2 is a front view thereof.

The apparatus shown comprises an apparatus cabinet 2, which constitutes or includes a suction box as connected with a suction blower (not shown). Two turn tubes 3 are connected with the suction box such that air may be drawn into the suction box through these tubes.

Each turn tube 3 is generally inverted L-shaped, having a lower straight leg portion 4 and an upper straight and horizontal portion 6, which is mounted in a sealed rotation bearing 8 in the wall of the said suction box so as to be rotatably adjustable about an axis a. The axes a of the two upper tube portions 6 extend parallel with each other and mutually spaced a distance x in a common horizontal plane. The lower leg portion 4 of each turn tube 3 is bent downwardly through 90° from the upper tube portion 6 so as to be pivotal about the respective associated axis a. It will be understood that the upper tube portions 6 are rotatable by pivoting the tube leg portions 4, such that these portions may be brought to assume any desired mutual angular positions in their common horizontal plane. The bearings 8 may be frictional bearings capable of holding the turn tubes against incidental, moderate pivot forces on the tube leg portions 4.

The lower end opening of each tube leg 4 is designated 10, and it will be understood that by the said pivoting of the tube legs 4 it will be possible to adjust the distance, designated y, between these openings 10 to any desired size within a wide range of sizes as corresponding to the armhole distance of shirts or other relevant garments ranging from very small to very large sizes.

The turn tubes 3 may be positively lockable in their desired positions e.g. by means of an upper clamping gallow 11 operable to clamp lock the upper tube portions 6 by means of a clamping screw 12.

As shown in FIG. 1 and still more clearly in FIG. 2 the lower openings 10 of the tube legs 4 are shaped so as to be obliquely outwardly oriented, whereby they are well suited to cooperate with armholes 15 of a shirt 16 or a similar garment 16, the body portion 18 of which is drawn up along the tube legs 4 with its sleeves 20 hanging down from the contact areas between the tube ends 10 and the armholes 15.

Owing to the intake of suction air through the tube ends 10 the sleeves 20 will thereafter be turned by being sucked into the tube legs 4. Conveniently the apparatus is provided or associated with suction control means to be actuated by the operator once the garment 16 has been placed in its correct position as cooperating with the openings 10 in the desired manner, but such control means, is not be described in more detail, as they are already well known in the art.

In FIG. 2 it is shown that the upper tube portions 6 may be provided with pointers cooperating with arched scales 14 on the front side of the suction box for indicating the angular position of the respective tube leg 4, expressed e.g. in terms of the real distance y between the lower openings 10 of the tube leg portions 4, such real distance being identified either by absolute measures or by figures relating to standard garment size numbers. Here, one turn tube may be stationary while only the other is adjustable.

In a preferred embodiment, however, the two upper tube portions 6 are coupled together in a counter rotational manner, e.g. by means of interengaging tooth segments 22 as shown in dotted lines in FIG. 2, such that the two tube legs 4 are bound to be pivoted in a symmetrical manner, whereby it is of course sufficient that the angular position of one of the tube legs is indicated on a scale 14 for adjustment to any desired distance y between the tube end openings 10 as given e.g. by the size number of a following series of garments to be handled by the apparatus.

It is apparent from FIG. 2 that the orientation of the lower end openings 10 will not be changed in any significant manner when the tube legs 4 are adjusted to accommodate garments of reduced or increased size, i.e. these openings will be advantageously oriented for all relevant garment sizes.

It will be appreciated that the essential feature of the invention is the pivotal arrangement of the outer tube end portions 4 about the axes a and that this arrangement is not necessarily bound to the use of the rotatably mounted inner tube end portions 6. Thus, the tube portions 4, instead of continuing through bends into the tube portions 6, may have open top ends, which are connected with the suction box through flexible hoses, while the tubes 4 are otherwise, externally, connected with the suction box 2 in the relevant pivotable manner. The pivot axis should not necessarily intersect the middle axis of the respective tube portion 4.

Moreover, the advantageous use of the pivotal turn tubes is not necessarily conditioned by these tubes or their pivot means being mechanically connected directly with the suction box, inasfar as the turn tubes may be mechanically held by any suitable carrier structure and pneumatically connected to the suction box through suitably flexible connector means.

I claim:

1. An apparatus for turning tubular garment portions such as sleeves of shirts and sweaters, comprising a suction box and a pair of turn tubes projecting from said suction box to respective outer, open ends thereof so as to be operable to suck in air through said outer ends and arranged so as to be operable to receive, at their outer ends, respective relevant base portions of tubular garment portions to be turned by suction into the turn tubes, said turn tubes being mounted so as to be adjustable with respect to the mutual distance between their said respective outer ends, wherein the turn tubes are mechanically held by rotatable holding means so that said turn tubes are pivotable about respective, substantially parallel pivot axes located adjacent the axes of the respective turn tubes and spaced from the outer ends thereof, said pivot axes being substantially perpendicular to the axes of said turn tubes.

2. An apparatus according to claim 1, in which the distance between the pivot axes of the turn tubes is of a magnitude corresponding to the distance between the armholes of a shirt.

3. An apparatus according to claim 1, in which the length of the turn tubes as measured between the outer ends and the respective pivot axis thereof is of a magnitude corresponding to the length of a shirt sleeve.

4. An apparatus according to claim 1, in which each turn tube, opposite its outer free end, continues through a tube bend in a basic tube portion, which projects into the suction box and is rotably secured thereto.

5. An apparatus according to claim 1, in which the outer end edge planes of the turn tubes are inclined relative the longitudinal axes of the respective turn tubes such that the end openings of the turn tubes are oriented generally away from each other.

6. An apparatus according to claim 1, in which means are provided for releasably arresting the turn tubes in mutual positions corresponding to any desired distance between the outer ends of the turn tubes.

7. An apparatus according to claim 1, in which said rotatable holding means include indicator means operable to indicate the degree of rotary displacement of the holding means from a predetermined basic or zero position to thereby indicate the distance between the free ends of the two turn tubes.

8. An apparatus according to claim 1, in which the rotatable holding means of the opposed turn tubes are provided with interacting movement control means operable to impart to one turn tube the same, though opposite, angular movement as effected on the other turn tube.

* * * * *